US007516523B2

(12) United States Patent
Okot

(10) Patent No.: US 7,516,523 B2
(45) Date of Patent: Apr. 14, 2009

(54) CONCEALED ZIPPER

(75) Inventor: Alex W. Okot, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 261 days.

(21) Appl. No.: 11/394,128

(22) Filed: Mar. 30, 2006

(65) Prior Publication Data

US 2007/0214614 A1 Sep. 20, 2007

Related U.S. Application Data

(60) Provisional application No. 60/783,050, filed on Mar. 15, 2006.

(51) Int. Cl.
*A44B 19/24* (2006.01)

(52) U.S. Cl. ..... 24/385; 24/382

(58) Field of Classification Search ..... 24/381, 24/386, 387, 415, 429, 432, 436, 382, 383, 24/385, 416–431; 70/67–70; 292/283
See application file for complete search history.

(56) References Cited

U.S. PATENT DOCUMENTS

| | | | | |
|---|---|---|---|---|
| 2,353,086 | A | 7/1944 | Schaaff | |
| 2,846,689 | A | 8/1958 | Engel | |
| 2,905,230 | A * | 9/1959 | Gabriel | 24/386 |
| 3,597,945 | A * | 8/1971 | Feinberg | 70/68 |
| 3,751,732 | A | 8/1973 | Mott | |
| 4,123,829 | A * | 11/1978 | Takabatake | 24/386 |
| 4,350,375 | A * | 9/1982 | Bako | 24/386 |
| 4,388,738 | A * | 6/1983 | Wagner | 5/421 |
| 5,031,944 | A * | 7/1991 | Keyaki | 24/387 |
| 5,848,455 | A | 12/1998 | Ikehara | |
| 6,308,541 | B1 * | 10/2001 | Stowe | 70/68 |
| 6,332,249 | B1 | 12/2001 | Oda | |
| 6,928,703 | B2 | 8/2005 | Petravic | |
| 7,464,569 | B2 * | 12/2008 | Kolton et al. | 24/381 |
| 2003/0177616 | A1 | 9/2003 | Petravic et al. | |
| 2004/0020017 | A1 | 2/2004 | Nedbal | |

FOREIGN PATENT DOCUMENTS

| | | | |
|---|---|---|---|
| EP | 0 280 339 | * | 1/1988 |
| JP | 2001238709 | A | 9/2001 |
| JP | 2005-344228 | A | 12/2005 |
| WO | 2006055378 | A2 | 5/2006 |
| WO | 2006137293 | A1 | 12/2006 |

OTHER PUBLICATIONS

Okot, Covered Zipper Pull Assembly, U.S. Appl. No. 10/988,893, filed Nov. 15, 2004.
PCT/US2007/063119.

* cited by examiner

*Primary Examiner*—Robert J Sandy
*Assistant Examiner*—Ruth C Rodriguez
(74) *Attorney, Agent, or Firm*—Banner and Witcoff, Ltd.

(57) ABSTRACT

A concealed zipper assembly includes a pair of zipper tapes and a pair of sliders movable along the zipper tapes and defining an opening therebetween. The sliders are configured to close the zipper tapes and the opening as they move toward one another along the zipper tapes. A cover is connected to each of the sliders and is movable along the zipper tapes.

35 Claims, 1 Drawing Sheet

CONCEALED ZIPPER

This application claims priority to provisional U.S. Application Ser. No. 60/783,050, entitled "Concealed Zipper," filed Mar. 15, 2006 by Alex. W. Okot.

FIELD OF THE INVENTION

This invention relates generally to a zipper, and, in particular, to a concealed zipper useful in conjunction with a drawstring.

BACKGROUND OF THE INVENTION

Articles of apparel, luggage, backpacks, sporting equipment and other items use closure assemblies, such as zippers, drawstrings, straps, cords, etc., to close, tighten or otherwise adjust a portion of the article. For example, hooded coats and sweatshirts often incorporate a drawstring to tighten the hood about the user's face and head. When drawstrings are used on a hood of a coat or jacket, for example, the hanging drawstring can be cumbersome and an annoyance, and may create a safety issue due to the drawstring getting caught in or on another object. This can be especially dangerous for children.

To address this issue and other concerns, zippers have been developed that incorporate a hidden closure assembly, such as a drawstring, beneath the zipper tape. The zipper stays sealed on either side of the zipper pull, thereby covering the drawstring or other closure assembly at all times.

It would be desirable to provide a concealed zipper for use with a drawstring that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide a concealed zipper, which is particularly useful in conjunction with a drawstring. In accordance with a first aspect, a concealed zipper assembly includes a pair of zipper tapes and a pair of sliders movable along the zipper tapes and defining an opening therebetween. The sliders are configured to close the zipper tapes and the opening as they move toward one another along the zipper tapes. A cover is connected to each of the sliders and is movable along the zipper tapes In accordance with another aspect, an object with a concealed zipper assembly includes an object having a channel formed therein. A drawstring is positioned within the channel and has a first end and a second end. A pair of zipper tapes is secured to an exterior surface of the channel. A pair of sliders is movable along the zipper tapes and defines an opening therebetween, with the sliders configured to close the zipper tapes and the opening as they move toward one another along the zipper tapes. A cover is connected to each of the sliders and is movable along the zipper tapes, with the first end of the drawstring being secured to the cover.

In accordance with a further aspect, an article of apparel with a concealed zipper assembly includes an article of apparel having a channel formed therein. A drawstring is positioned within the channel and has a first end and a second end. A first pair of zipper tapes is secured to an exterior surface of the channel. A first pair of sliders is movable along the first pair of zipper tapes and defines a first opening therebetween. The first pair of sliders is configured to close the first pair of zipper tapes and the first opening as they move toward one another along the first pair of zipper tapes, with each slider of the first pair of sliders having a zipper pull. A first cover has a pair of recesses formed therein, with each recess of the first cover receiving one of the zipper pulls of the first pair of sliders, and the first end of the drawstring being secured to the first cover. A second pair of zipper tapes is secured to an exterior surface of the channel. A second pair of sliders is movable along the second pair of zipper tapes and defines a second opening therebetween. The second pair of sliders is configured to close the second pair of zipper tapes and the second opening as they move toward one another along the second pair of zipper tapes, with each slider of the second pair of sliders having a zipper pull. A second cover has a pair of recesses formed therein, with each recess of the second cover receiving one of the zipper pulls of the second pair of sliders, and the second end of the drawstring being secured to the second cover.

Substantial advantage is achieved by providing a concealed zipper. In particular, certain embodiments provide improved safety for the user, reducing the chances of the user getting scraped or otherwise harmed by the zipper and, in embodiments with a concealed drawstring, preventing entanglement of the drawstring.

These and additional features and advantages disclosed here will be further understood from the following detailed disclosure of certain embodiments.

Figure 1:
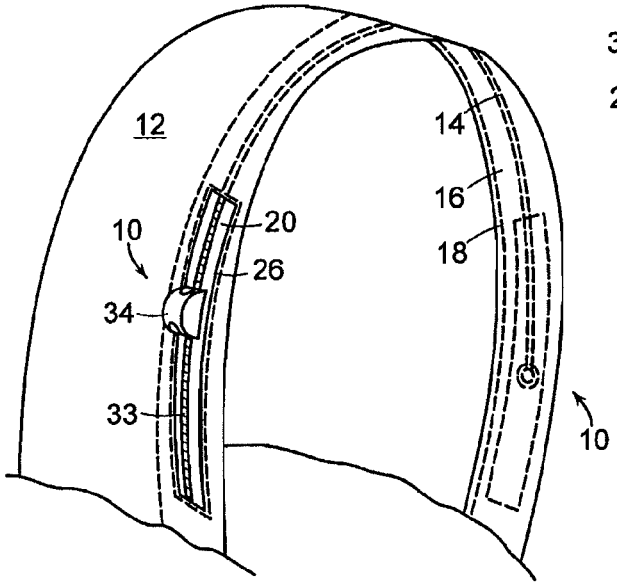
FIG. 1 is a perspective view of a pair of concealed zippers shown in use on a hood of an article of apparel.

The figures referred to above are not drawn necessarily to scale and should be understood to provide a representation of the invention, illustrative of the principles involved. Some features of the concealed zipper assembly depicted in the drawings have been enlarged or distorted relative to others to facilitate explanation and understanding. The same reference numbers are used in the drawings for similar or identical components and features shown in various alternative embodiments. Concealed zipper assemblies as disclosed herein would have configurations and components determined, in part, by the intended application and environment in which they are used.

DETAILED DESCRIPTION OF CERTAIN PREFERRED EMBODIMENTS

Figure 2:
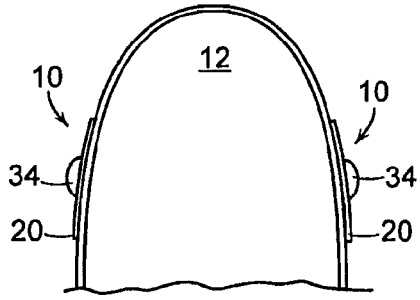
FIG. 2 is a front elevation view of the concealed zippers on the hood of FIG. 1.

The present invention may be embodied in various forms. A preferred embodiment of a concealed zipper assembly 10 is shown in FIGS. 1-2. As seen here, a pair of zipper assemblies 10 can be seen in use on a hood 12 of an article of apparel such as a jacket or sweatshirt, with a first zipper assembly 10 positioned on the left side of hood 12 and the second zipper assembly 10 positioned on the right side of hood 12. It is to be appreciated that zipper assembly 10 can be used on a variety of objects including, for example, other articles of apparel, backpacks, knapsacks, duffle bags and other bags. Other suitable applications for zipper assembly 10 will become readily apparent to those skilled in the art, given the benefit of this disclosure.

In the illustrated embodiment, zipper assemblies 10 are secured to opposed ends of a closure member such as a drawstring 14 that is captured within a channel 16 formed in hood 12. By moving zipper assemblies 10 up and down along hood 12, drawstring 14 can alternately be cinched or loosened, thereby alternately tightening and loosening hood 12 about the head of the user. Channel 16 serves to keep drawstring 14 concealed within hood 12, reducing the chances of drawstring 14 getting caught in or on another object, thereby improving the safety of the user. Channel 16 may be formed by folding over an edge of hood 12 and securing it with stitching 18, for example. In other embodiments, channel 16 could be formed by securing a separate piece of material to hood 12 along opposed edges thereof by stitching, for example.

Figure 4:
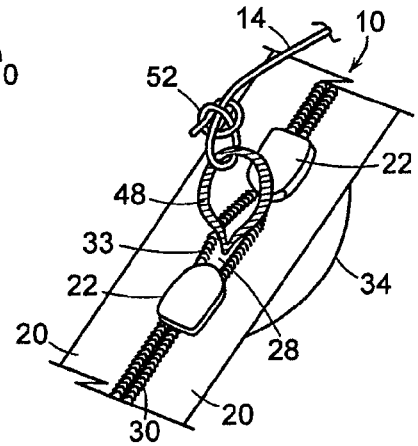
FIG. 4 is a perspective view of an interior of a concealed zipper of FIG. 1.
Figure 3:
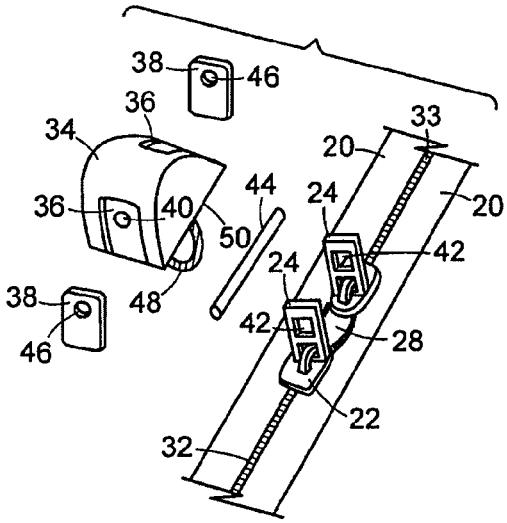
FIG. 3 is a perspective view, in exploded form, of a concealed zipper of FIG. 1.

As seen more clearly in FIGS. 3-4, each zipper assembly 10 includes a pair of opposed zipper tapes 20 and a pair of sliders 22. Sliders 22 each include a zipper pull 24 used to move sliders 22 along zipper tapes 20. Each of sliders 22 advantageously may be a conventional slider (which are typically used alone on a pair of zipper tapes), thereby reducing the cost of manufacture of zipper assembly 10. Zipper tapes 20 may be secured along edges thereof to channel 16 of hood 12 with stitching 26, as seen in FIG. 1. It is to be appreciated that zipper tapes 20 may be secured to hood 12 with adhesive or any other suitable fastening means.

Sliders 22 are configured to provide an opening 28 in zipper tapes 20 between sliders 22. Thus, sliders 22 are configured to open zipper assembly 10, and opening 28, as they move away from one another, and to close zipper assembly 10 and opening 28 as they move toward one another in what may be termed a face-to-face orientation. In certain embodiments, sliders 22 are formed of a durable plastic, e.g., polyurethane.

Zipper tapes 20 have an inverted configuration with respect to a standard zipper installation. That is, zipper tapes 20 are secured to hood 12 with a coil side 30 positioned within channel 16 and concealed from the user, and a flat side 32 positioned on the exterior of hood 12 and exposed to the user. Thus, the smoother flat side 32 is exposed to the individual, and the rougher coil side 30 is contained within channel 16, protecting the user's face, hands and other body parts from the ridges of the coils, thereby improving the comfort and safety of zipper assembly 10. In certain embodiments, the teeth 33 of zipper tapes 20 may be formed of a durable plastic, e.g., polyurethane.

Zipper assembly 10 includes a cover 34 for sliders 22. In the illustrated embodiment, cover 34 has a pair of recesses 36, with each recess 36 configured to receive a zipper pull 24. Each of a pair of recess covers 38 is positioned within recess 36 on top of a corresponding zipper pull 24, thereby concealing and retaining zipper pulls 24 within cover 34. In a preferred embodiment, an aperture 40 is provided in cover 34, and apertures 42 are provided in each of zipper pulls 24. A rod 44 extends through apertures 42 of zipper pulls 24 and aperture 40 of cover 34, thereby securing zipper pulls 24 to cover 34. In certain embodiments, an aperture 46 in each of recess covers 38 receives a corresponding end of rod 44.

Cover 34 serves to act as an operating member for sliders 22, allowing the user to simultaneously operate both sliders, thereby moving drawstring 14 in a desired direction. Cover 34 also serves to conceal any sharp or protruding edges of sliders 22 and zipper pulls 24, thereby reducing the chance of the user getting scraped or otherwise injured from zipper assembly 10. In certain embodiments, as illustrated in FIGS. 1-3, cover 34 has a rounded or curved exterior configuration to reduce the possibility of any sharp edges harming the user.

A retaining member 48 projects from a rear surface 50 of cover 34 and extends through opening 28 in zipper tapes 20. In the illustrated embodiment, retaining member 48 is a loop 48. Loop 48 may be an elongate member such as cord or string formed in a loop, or a solid material such as metal or plastic, for example. An end of drawstring 14 is secured to each retaining member 48 by a knot 52 or any other suitable fastening means such that drawstring 14 is connected at each end to a cover 34. It is to be appreciated that retaining member 48 can have any configuration suitable for securing an end of drawstring 14.

To operate a zipper assembly 10, the user grasps cover 34, moving it, as well as its associated pair of sliders 22, the opening 28 in zipper tapes 20 between sliders 22, and retaining member 48, up and down along zipper tapes 20. The movement of cover 34 causes the respective end of drawstring 14 to be moved as well, thereby tightening hood 12 about the user's head when cover 34, and sliders 22, are moved downwardly along zipper tapes 20, and loosening hood 12 when cover 34, and sliders 22, are moved upwardly along zipper tapes 20. Thus, drawstring 14, which is completely concealed within channel 16 can easily be tightened and loosened simply by grasping and moving covers 34. It is to be appreciated that one or both zipper assemblies 10 can be operated at any time.

Figure 5:
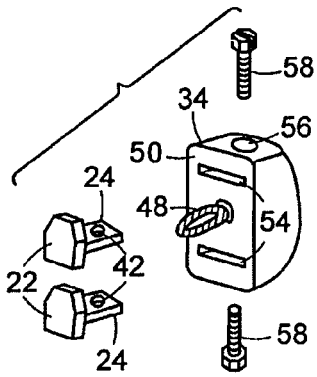
FIG. 5 is a perspective view, in exploded form, of an alternative embodiment of a portion of a concealed zipper.

Another embodiment of cover 34 is seen in FIG. 5, in which a pair of recesses 54 is formed in rear surface 50 of cover 34. A zipper pull 24 is received in each recess 54. A pair of apertures 56 are formed in cover 34 (only one aperture 56 being visible in FIG. 5), with each aperture 56 being in communication with a corresponding recess 54. A fastener such as a threaded screw 58 extends through each aperture 56 and through a corresponding aperture 42 in a zipper pull 24, thereby securing sliders 22 to cover 34. In certain embodiments, screws 58 are formed of plastic, although it is to be appreciated that screws 58 can be formed of any material. Thus, it can be seen that there are a variety of ways of securing sliders 22 to cover 34 such that sliders 22 move along zipper tapes 20 as the user moves cover 34.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. A concealed zipper assembly comprising, in combination:

a pair of zipper tapes;

a pair of sliders movable along the zipper tapes and defining an opening therebetween, the sliders configured to close the zipper tapes and the opening as they move toward one another along the zipper tapes, each slider including a zipper pull, each zipper pull including an aperture formed therein; and a cover connected to each of the sliders and movable along the zipper tapes, the cover including a pair of recesses, each recess receiving a portion of only one of the zipper pulls that includes the aperture formed therein.

2. The concealed zipper assembly of claim 1, further comprising a retaining member secured to the cover and extending through the opening.

3. The concealed zipper assembly of claim 2, further comprising a closure member secured to the retaining member.

4. The concealed zipper assembly of claim 3, wherein the closure member comprises a drawstring.

5. The concealed zipper assembly of claim 4, further comprising a channel, the drawstring being positioned within the channel.

6. The concealed zipper assembly of claim 2, wherein the retaining member comprises a loop.

7. The concealed zipper assembly of claim 1, further comprising:

an aperture extending through the cover;

an aperture extending through each zipper pull; and a rod extending through the aperture in the cover and the apertures in the zipper pulls.

8. The concealed zipper assembly of claim 1, further comprising a pair of recess covers, each recess cover positioned in a recess and covering a zipper pull.

9. The concealed zipper assembly of claim 1, wherein the cover includes a pair of apertures with each aperture being in communication with a corresponding recess, and each zipper pull includes an aperture, and further comprising a pair of screws, each screw extending through an aperture in the cover and an aperture in one of the zipper pulls.

10. The concealed zipper assembly of claim 1, further comprising a pair of fasteners, each fastener securing a corresponding zipper pull to the cover.

11. The concealed zipper assembly of claim 10, wherein the fasteners are screws.

12. The concealed zipper assembly of claim 1, wherein the zipper tapes have a flat side and a coil side, the sliders and cover being positioned on the flat side.

13. An object with a concealed zipper assembly comprising, in combination:

an object having a channel formed therein;

a drawstring positioned within the channel and having a first end and a second end;

a pair of zipper tapes secured to an exterior surface of the channel;

a pair of sliders movable along the zipper tapes and defining an opening therebetween, each slider including a zipper pull, the sliders configured to close the zipper tapes and the opening as they move toward one another along the zipper tapes; and a cover connected to each of the sliders and movable along the zipper tapes, the first end of the drawstring being secured to the cover.

14. The object of claim 13, wherein the zipper tapes have a coil side exposed to an interior of the channel and an opposed flat side exposed to an exterior of the channel.

15. The object of claim 13, further comprising:

an aperture extending through the cover;

an aperture extending through each zipper pull; and a rod extending through the apertures in the zipper pull and the aperture in the cover.

16. The object of claim 13, wherein the cover includes a pair of recesses, each recess receiving a zipper pull.

17. The object of claim 16, further comprising a pair of recess covers, each recess cover positioned in a recess and covering a zipper pull.

18. The object of claim 16, wherein the cover includes a pair of apertures with each aperture being in communication with a corresponding recess and each zipper pull includes an aperture, and further comprising a pair of screws, each screw extending through an aperture in the cover and an aperture in one of the zipper pulls.

19. The object of claim 13, further comprising a retaining member secured to the cover and extending through the opening, the first end of the drawstring being secured to the retaining member.

20. The object of claim 19, wherein the retaining member comprises a loop.

21. The object of claim 13, further comprising:

a second pair of zipper tapes secured to an exterior surface of the channel;

a second pair of sliders movable along the second pair of zipper tapes and defining a second opening therebetween, the second pair of sliders configured to close the second pair of zipper tapes and the second opening as they move toward one another along the second pair of zipper tapes; and a second cover receiving a portion of each of the second pair of sliders, the second end of the drawstring being secured to the second cover.

22. An article of apparel with a concealed zipper assembly comprising, in combination:

an article of apparel having a channel formed therein;

a drawstring positioned within the channel and having a first end and a second end;

a first pair of zipper tapes secured to an exterior surface of the channel;

a first pair of sliders movable along the first pair of zipper tapes and defining a first opening therebetween, the first pair of sliders configured to close the first pair of zipper tapes and the first opening as they move toward one another along the first pair of zipper tapes, each slider of the first pair of sliders having a zipper pull;

a first cover having a pair of recesses formed therein, each recess of the first cover receiving only one of the zipper pulls of the first pair of sliders, the first end of the drawstring being secured to the first cover;

a second pair of zipper tapes secured to an exterior surface of the channel;

a second pair of sliders movable along the second pair of zipper tapes and defining a second opening therebetween, the second pair of sliders configured to close the second pair of zipper tapes and the second opening as they move toward one another along the second pair of zipper tapes, each slider of the second pair of sliders having a zipper pull; and a second cover having a pair of recesses formed therein, each recess of the second cover receiving only one of the zipper pulls of the second pair of sliders, the second end of the drawstring being secured to the second cover.

23. The article of apparel of claim 22, further comprising a first retaining member secured to the first cover and extending through the first opening, the first end of the drawstring being secured to the first retaining member; and a second retaining member secured to the second cover and extending through the second opening, the second end of the drawstring being secured to the second retaining member.

24. The article of apparel of claim 23, wherein the retaining members comprise loops.

25. The article of apparel of claim 23, wherein the zipper tapes have a flat side and a coil side, the sliders and covers being positioned on the flat sides of the zipper tapes.

26. The article of apparel of claim 23, further comprising:

an aperture extending through the each cover;

an aperture extending through each zipper pull;

a first rod extending through the aperture in the first cover and the apertures in the first pair of zipper pulls; and a second rod extending through the aperture in the second cover and the apertures in the second pair of zipper pulls.

27. The article of apparel of claim 22, wherein the first cover includes a pair of apertures with each aperture being in communication with a corresponding recess, and each of the first zipper pulls includes an aperture, and further comprising a first pair of screws, each screw of the first pair of screws extending through an aperture in the first cover and an aperture in one of the first pair of zipper pulls; and the second cover includes a pair of apertures with each aperture being in communication with a corresponding recess, and each of the second zipper pulls includes an aperture, and further comprising a second pair of screws, each screw of the second pair of screws extending through an aperture in the second cover and an aperture in one of the second pair of zipper pulls.

28. A concealed zipper assembly comprising, in combination:

a pair of sliders configured to move along a pair of zipper tapes and define an opening therebetween, and configured to close the zipper tapes and the opening as they move toward one another along the zipper tapes, each slider including a zipper pull, each zipper pull including an aperture formed therein;

a cover configured to be connected to each of the sliders, the cover including a pair of recesses, each recess receiving a portion of only one of the zipper pulls that includes the aperture formed therein; and a retaining member secured to the cover.

29. The concealed zipper assembly of claim 28, wherein the retaining member comprises a loop.

30. The concealed zipper assembly of claim 28, further comprising:

an aperture extending through the cover;

an aperture extending through each zipper pull; and a rod extending through the aperture in the cover and the apertures in the zipper pulls.

31. The concealed zipper assembly of claim 28, wherein the cover includes a pair of recesses, each zipper pull being received in a recess.

32. The concealed zipper assembly of claim 31, further comprising a pair of recess covers, each recess cover positioned in a recess and covering a zipper pull.

33. The concealed zipper assembly of claim 31, wherein the cover includes a pair of apertures with each aperture being in communication with a corresponding recess, and each zipper pull includes an aperture, and further comprising a pair of screws, each screw extending through an aperture in the cover and an aperture in one of the zipper pulls.

34. The concealed zipper assembly of claim 28, further comprising a pair of fasteners, each fastener securing a corresponding zipper pull to the cover.

35. The concealed zipper assembly of claim 34, wherein the fasteners are screws.

* * * * *